US009307580B2

(12) United States Patent
Lee et al.

(10) Patent No.: US 9,307,580 B2
(45) Date of Patent: Apr. 5, 2016

(54) INDUCTION HEATING COOKER AND CONTROL METHOD THEREOF

(75) Inventors: Sung Ho Lee, Suwon-si (KR); Jong Chull Shon, Suwon-si (KR); Min Gyu Jung, Suwon-si (KR); Ha Na Kim, Incheon (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1035 days.

(21) Appl. No.: 13/428,371

(22) Filed: Mar. 23, 2012

(65) Prior Publication Data

US 2012/0248096 A1 Oct. 4, 2012

(30) Foreign Application Priority Data

Apr. 1, 2011 (KR) ..... 10-2011-0030304

(51) Int. Cl.
*H05B 6/12* (2006.01)
*H05B 6/06* (2006.01)

(52) U.S. Cl.
CPC ..... *H05B 6/062* (2013.01); *H05B 2213/03* (2013.01); *H05B 2213/05* (2013.01)

(58) Field of Classification Search
CPC . H05B 1/0266; H05B 6/1209; H05B 2213/03
USPC ..... 219/622, 620, 624–626, 662, 663, 665, 219/671, 672; 307/141, 141.8; 361/89, 94
See application file for complete search history.

(56) References Cited

U.S. PATENT DOCUMENTS

| | | | | |
|---|---|---|---|---|
| 5,808,280 | A * | 9/1998 | Gaspard | 219/624 |
| 2007/0164017 | A1* | 7/2007 | Gouardo et al. | 219/626 |
| 2009/0139986 | A1* | 6/2009 | Lee et al. | 219/622 |

FOREIGN PATENT DOCUMENTS

| | | | |
|---|---|---|---|
| EP | 1 487 239 | A1 | 12/2004 |
| EP | 1 517 091 | A2 | 3/2005 |
| EP | 2034799 | A1 * | 3/2009 |
| EP | 2 395 813 | A1 | 12/2011 |
| EP | 2 416 621 | A1 | 2/2012 |
| JP | 2004-185829 | | 7/2004 |
| WO | WO 2010118943 | A1 * | 10/2010 |
| WO | 2010/140283 | A1 | 12/2010 |

OTHER PUBLICATIONS

Extended European Search Report for European Application No. 12160898.8, mailed Oct. 2, 2012.
European Decision on Grant dated Sep. 17, 2015 in European Patent Application No. 12160898.8.

* cited by examiner

*Primary Examiner* — Quang Van
(74) *Attorney, Agent, or Firm* — Staas & Halsey LLP

(57) ABSTRACT

An induction heating cooker and a control method thereof that prevents the occurrence of an error caused during recognition of a container in the induction heating cooker that performs cooking regardless of where the container is placed on a cooking plate includes a plurality of heating coils disposed below a cooking plate, current detectors to detect values of current flowing in the respective heating coils, and a controller to determine whether a container is placed on the respective heating coils based on the detected current values of the heating coils and change amounts of the current values.

7 Claims, 7 Drawing Sheets

INDUCTION HEATING COOKER AND CONTROL METHOD THEREOF

CROSS-REFERENCE TO RELATED APPLICATIONS

This application claims the priority benefit of Korean Patent Application No. 2011-0030304, filed on Apr. 1, 2011 in the Korean Intellectual Property Office, the disclosure of which is incorporated herein by reference.

BACKGROUND

1. Field

The following description relates to an induction heating cooker and a control method thereof that heats a container regardless of where the container is placed on a cooking plate.

2. Description of the Related Art

Generally, an induction heating cooker is a device that supplies high-frequency current to a heating coil to generate a strong high-frequency magnetic field and generates eddy current in a cooking container (hereinafter, referred to as a container) magnetically coupled to the heating coil using the magnetic field to heat the container using Joule heat generated by the eddy current, thereby cooking food.

An induction heating cooker includes a plurality of heating coils fixedly mounted in a main body forming the external appearance thereof to provide a heat source. Also, a cooking plate, on which a container is placed, is disposed at the top of the main body. Container lines are formed at positions of the cooking plate corresponding to the heating coils. The container lines serve to guide positions on which a user places a container to cook food.

When food is cooked using the conventional induction heating cooker, however, a user may have trouble correctly placing a container on the cooking plate at a corresponding one of the container lines so that cooking (i.e. heating of the container) is effectively performed. That is, if the user places the container at a position deviating from the container lines, cooking may not be properly performed.

In recent years, an induction heating cooker has been developed wherein a large number of heating coils is disposed below a cooking plate over the entire surface of the cooking plate so that cooking is effectively performed regardless of where a container is placed on the cooking plate.

In the aforementioned induction heating cooker, however, a container may partially occupy the heating coils when the container is placed on the cooking plate. When the induction heating cooker recognizes the container partially occupying the heating coils, the distinction between the case in which the container partially occupies the heating coils and a case in which no container is placed on the cooking plate may not be clearly made due to the lack of occupation percentage.

SUMMARY

It is an aspect to provide an induction heating cooker and a control method thereof that prevent the occurrence of an error caused during recognition of a container in the induction heating cooker that performs cooking regardless of where the container is placed on a cooking plate.

Additional aspects will be set forth in part in the description which follows and, in part, will be obvious from the description, or may be learned by practice of the invention.

In accordance with an aspect, an induction heating cooker includes a plurality of heating coils disposed below a cooking plate, current detectors to detect values of current flowing in the respective heating coils, and a controller to determine whether a container is placed on the respective heating coils based on the detected current values of the heating coils and change amounts of the current values.

The induction heating cooker may further include inverters having switching elements, wherein the current detectors may detect values of current flowing in the respective heating coils during on time of the switching elements of the inverters.

The controller may determine that the container is placed on the respective heating coils if the current values detected from the respective heating coils during the on time of the switching elements are equal to or greater than a predetermined value and a pattern is formed in which the change amount of the current values during the on time of the switching elements increases over time.

The controller may divide the on time of the switching elements into one or more sections, control the current detectors to detect current values in the respective sections at a predetermined time interval, calculate an average value of the current values detected by the current detectors in the respective sections, and determine that the container is placed on the respective heating coils if a pattern is formed in which the calculated average value of the current values in the respective sections increases over time.

The controller may calculate an average value of the current values detected by the current detectors in the respective sections excluding a maximum value and minimum value thereof.

The current values of the respective heating coils detected during on time of the switching elements may be current values of the respective heating coils detected in a predetermined section of the on time of the switching elements.

The current value of each of the heating coils equal to or greater than the predetermined value may be one of the current values of the respective heating coils.

The current value of each of the heating coils equal to or greater than the predetermined value may be a maximum value of the current values of the respective heating coils.

The current value of each of the heating coils equal to or greater than the predetermined value may be an average value of the current values of the respective heating coils detected during the on time of the switching elements.

In accordance with another aspect, a control method of an induction heating cooker includes detecting values of current flowing in a plurality of heating coils for a predetermined time and determining whether a container is placed on the respective heating coils based on the detected current values of the heating coils and change amounts of the current values.

The determining whether the container is placed on the respective heating coils may include determining that the container is placed on the respective heating coils if the current values detected from the respective heating coils for the predetermined time are equal to or greater than a predetermined value and a pattern is formed in which the change amount of the current values for the predetermined time increases over time.

The determining whether the container is placed on the respective heating coils may include dividing the predetermined time into one or more sections, detecting current values in the respective sections at a predetermined time interval, calculating an average value of the current values detected in the respective sections, and determining that the container is placed on the respective heating coils if a pattern is formed in which the calculated average value of the current values in the respective sections increases over time.

The calculating the average value of the current values may include calculating an average value of the current values detected in the respective sections at the predetermined time interval excluding a maximum value and minimum value thereof.

The current value of each of the heating coils equal to or greater than the predetermined value may be one of the current values of the respective heating coils, a maximum value of the current values of the respective heating coils or an average value of the current values of the respective heating coils detected for the predetermined time.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
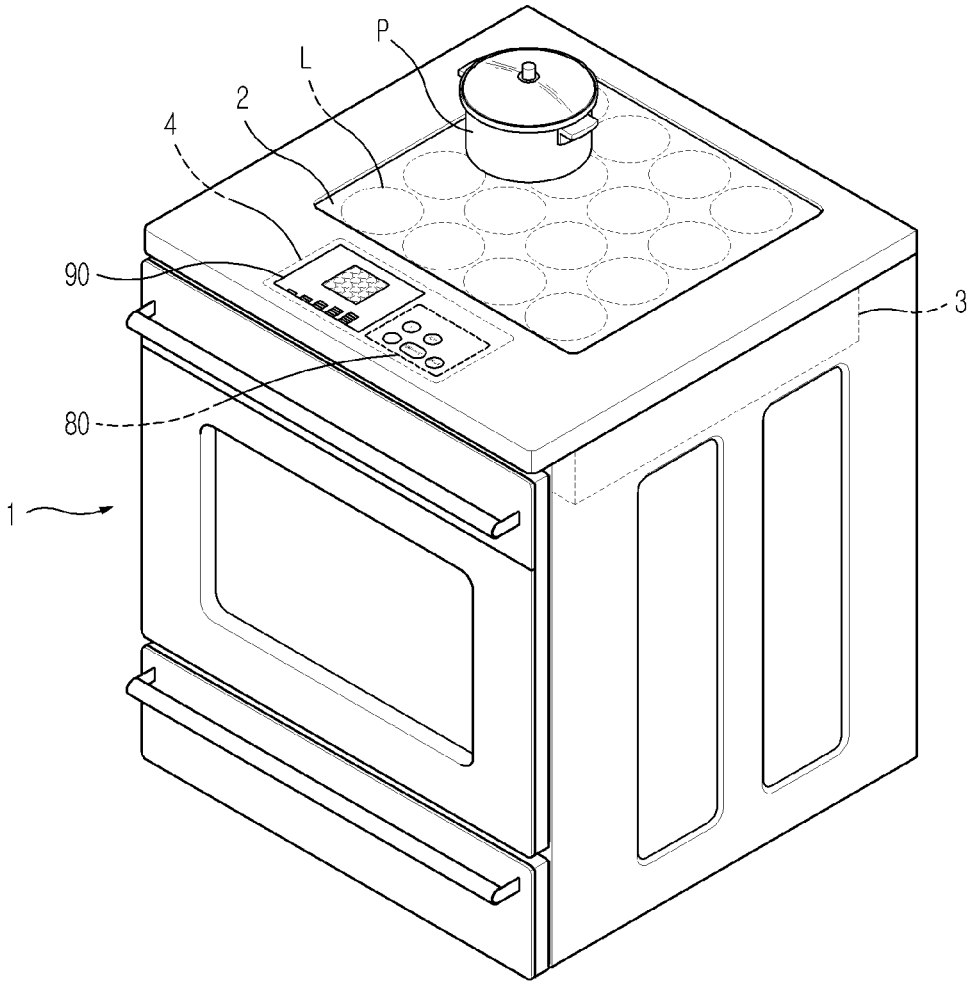
FIG. 1 is a perspective view illustrating the construction of an induction heating cooker according to an embodiment.

Reference will now be made in detail to the embodiments, examples of which are illustrated in the accompanying drawings, wherein like reference numerals refer to like elements throughout.

An induction heating cooker according to an embodiment is configured to have a structure in which small heating coils are densely disposed below the entire surface of a cooking plate so that a container containing food to be cooked is heated irrespective of a position where the container is placed.

When food is cooked using an induction heating cooker according to an embodiment, an operation to detect a position where a container is placed on a cooking plate (container position detection operation) may be necessary before a cooking operation is commenced after a user places the container on the cooking plate.

To determine a position where the container is placed on the cooking plate, high-frequency current may be supplied to a plurality of heating coils disposed below the cooking plate, values of current flowing in the heating coils may be detected, and it may be determined which of the heating coils the container is placed on by using the detected current values.

In a conventional induction heating cooker, a container uses a heating coil when the current value detection method is used, and therefore, a container containing food to be cooked rarely deviates from a heating coil zone. In the induction heating cooker according to an embodiment, on the other hand, a container containing food to be cooked may be placed on several heating coils simultaneously.

A container may be placed on several coils as follows: the container may be placed on large portions or small portions of the coils. In particular when the container is placed on small portions of the coils, detected values of current flowing in the corresponding heating coils may be small.

When no container is placed on a heating coil, on the other hand, a value of current flowing in the heating coil may be measured due to an influence of a container placed in a neighboring heating coil. Such a current value is called a noise current value.

If current values detected when the container is placed on small portions of the heating coils are very small, these current values may be smaller than a noise current value measured when no container is placed on a heating coil. That is, if it is determined whether a container is placed on the heating coils simply based on the current values, the placement of the container on the heating coils may not be accurately confirmed due to a noise current value. In the induction heating cooker according to the embodiment, therefore, current values of heating coils on which a container is placed are more concretely analyzed to determine whether the container is placed on the heating coils.

First, the structure of an induction heating cooker according to an embodiment will be described with reference to FIGS. 1 and 2.

FIG. 1 is a perspective view illustrating the construction of an induction heating cooker according to an embodiment.

As shown in FIG. 1, the induction heating cooker includes a main body 1. A cooking plate 2, on which a container P is placed, is disposed at the top of the main body 1.

In the main body 1, a plurality of heating coils L is disposed below the cooking plate 2 to supply heat to the cooking plate 2. The heating coils L are disposed below the cooking plate 2 throughout the entire surface of the cooking plate 2 at equal intervals. In this embodiment, as an example, 16 heating coils are disposed in a 4×4 matrix.

Alternatively, the heating coils L may be disposed below the cooking plate 2 throughout the entire surface of the cooking plate 2 at different intervals, in a different configuration, or with a different number of coils.

Also, a control device 3 to drive the heating coils L is provided below the cooking plate 2. Circuit constructions of the control device 3 will be described below in more detail with reference to FIG. 2.

Also, a control panel 4 including an input unit 80 having a plurality of manipulation buttons to input commands to drive the heating coils L to the control device 3 and a display unit 90 to display information related to the operation of the induction heating cooker is provided at the top of the main body 1.

Figure 2:
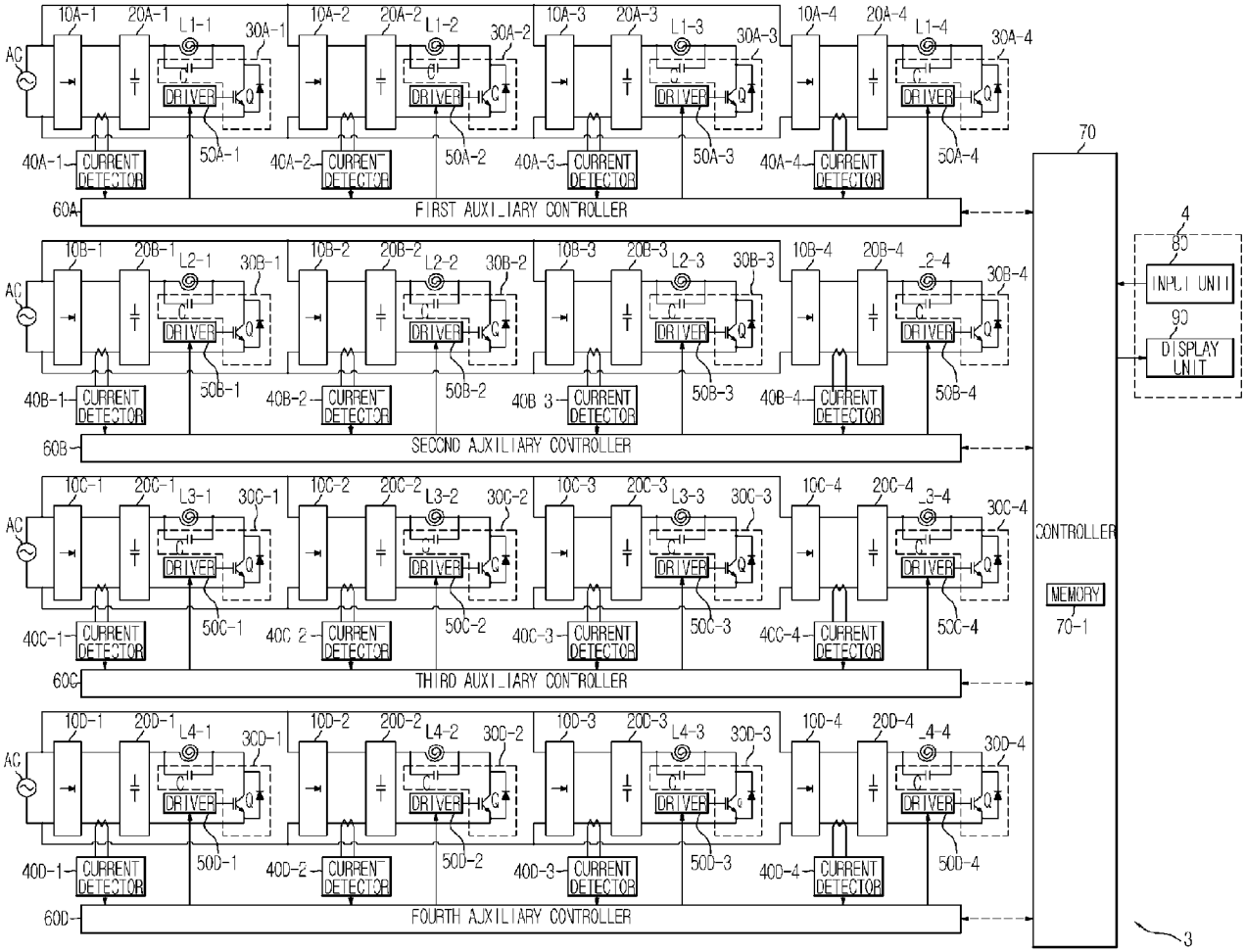
FIG. 2 is a control block diagram illustrating a control device of the induction heating cooker according to the embodiment.

FIG. 2 is a control block diagram illustrating the control device of the induction heating cooker according to the embodiment.

As shown in FIG. 2, the control device 3 includes four auxiliary controllers 60A, 60B, 60C, and 60D, a controller 70, an input unit 80 and a display unit 90.

Each of the auxiliary controllers 60A, 60B, 60C, and 60D is provided to control the driving of four heating coils L grouped as a single control unit among a total of 16 heating coils L disposed in a 4×4 matrix. The controller 70 is provided to control the four auxiliary controllers 60A, 60B, 60C, and 60D.

In this embodiment, each of the auxiliary controllers 60A, 60B, 60C, and 60D is provided for four heating coils L arranged at each row of the heating coils L disposed in the 4×4 matrix. That is, the first auxiliary controller 60A controls the driving of four heating coils L1-1, L1-2, L1-3, and L1-4 arranged at a first row of the 4×4 matrix, the second auxiliary controller 60B controls the driving of four heating coils L2-1, L2-2, L2-3, and L2-4 arranged at a second row of the 4×4 matrix, the third auxiliary controller 60C controls the driving of four heating coils L3-1, L3-2, L3-3, and L3-4 arranged at a third row of the 4×4 matrix, and the fourth auxiliary controller 60D controls the driving of four heating coils L4-1, L4-2, L4-3, and L4-4 arranged at a fourth row of the 4×4 matrix.

In reference marks LX-Y (X and Y are natural numbers) denoting the heating coils L, the first number X following the letter "L" indicates a row number, and the second number Y following the letter "L" indicates a column number. For example, reference mark L1-3 indicates a heating coil L arranged at a first row and third column of the 4×4 matrix.

Control constructions to drive the heating coils L1-1 to L1-4, L2-1 to L2-4, L3-1 to L3-4, and L4-1 to L4-4 arranged at the respective rows of the 16 heating coils L disposed in the 4×4 matrix are the same. Hereinafter, therefore, only the control construction to drive the four heating coils L1-1, L1-2, L1-3, and L1-4 arranged at the first row of the 4×4 matrix will be described in detail, and a description of the control constructions to drive the heating coils arranged at the other rows of the 4×4 matrix will be omitted.

As shown in the upper end of FIG. 2, a part of the control device 3 to drive the four heating coils L1-1, L1-2, L1-3, and L1-4 arranged at the first row of the 16 heating coils L disposed in the 4×4 matrix includes rectifiers 10A-1, 10A-2, 10A-3, and 10A-4, smoothers 20A-1, 20A-2, 20A-3, and 20A-4, inverters 30A-1, 30A-2, 30A-3, and 30A-4, current detectors 40A-1, 40A-2, 40A-3, and 40A-4, drivers 50A-1, 50A-2, 50A-3, and 50A-4, and a first auxiliary controller 60A.

The heating coils L1-1, L1-2, L1-3, and L1-4 are independently driven by the respective inverters 30A-1, 30A-2, 30A-3, and 30A-4 provided so as to correspond to the number of the heating coils L1-1, L1-2, L1-3, and L1-4. That is, the heating coil L1-1 is driven by the inverter 30A-1, the heating coil L1-2 is driven by the inverter 30A-2, the heating coil L1-3 is driven by the inverter 30A-3, and the heating coil L1-4 is driven by the inverter 30A-4.

The rectifiers 10A-1, 10A-2, 10A-3, and 10A-4 rectify input alternating current (AC) and output rectified ripple voltage.

The smoothers 20A-1, 20A-2, 20A-3, and 20A-4 smooth the ripple voltage provided from the rectifiers 10A-1, 10A-2, 10A-3, and 10A-4 and output uniform direct voltage obtained by smoothing.

The inverters 30A-1, 30A-2, 30A-3, and 30A-4 each include a switching element Q to switch the direct voltage provided from the smoothers 20A-1, 20A-2, 20A-3, and 20A-4 according to a switching control signal of the drivers 50A-1, 50A-2, 50A-3, and 50A-4 and to provide resonance voltage to the heating coils L1-1, L1-2, L1-3, and L1-4 and resonance condensers C connected in parallel to the respective heating coils L1-1, L1-2, L1-3, and L1-4 to continuously resonate with the respective heating coils L1-1, L1-2, L1-3, and L1-4 by input voltage.

When the switching elements Q of the inverters 30A-1, 30A-2, 30A-3, and 30A-4 are electrically conducted, the heating coils L1-1, L1-2, L1-3, and L1-4 and the resonance condensers C form a parallel resonance circuit. When the switching elements Q are cut off, on the other hand, current flows in the heating coils L1-1, L1-2, L1-3, and L1-4 in the direction opposite to high-frequency current flowing during the electrical conduction of the switching elements Q while charges, which were charged in the resonance condensers C during electrical conduction of the switching elements Q, are discharged.

The current detectors 40A-1, 40A-2, 40A-3, and 40A-4 are connected between the rectifiers 10A-1, 10A-2, 10A-3, and 10A-4 and the smoothers 20A-1, 20A-2, 20A-3, and 20A-4, respectively. The current detectors 40A-1, 40A-2, 40A-3, and 40A-4 detect values of current flowing in the heating coils L1-1, L1-2, L1-3, and L1-4 to detect the heating coils L1-1, L1-2, L1-3, and L1-4 on which the container P is placed and provide the detected current values to the first auxiliary controller 60A. The current detectors 40A-1, 40A-2, 40A-3, and 40A-4 are provided so as to correspond to the number of the heating coils L1-1, L1-2, L1-3, and L1-4, respectively, and include converter sensors (CT sensors).

The drivers 50A-1, 50A-2, 50A-3, and 50A-4 output a driving signal to the switching elements Q of the inverters 30A-1, 30A-2, 30A-3, and 30A-4 according to a control signal of the first auxiliary controller 60A to turn the switching elements Q on or off.

The first auxiliary controller 60A sends a control signal to the respective drivers 50A-1, 50A-2, 50A-3, and 50A-4 according to a control signal of the controller 70 to control the driving of the respective heating coils L1-1, L1-2, L1-3, and L1-4. Also, the first auxiliary controller 60A receives the values of current flowing in the heating coils L1-1, L1-2, L1-3, and L1-4, detected by the respective current detectors 40A-1, 40A-2, 40A-3, and 40A-4 and sends the received current values to the controller 70.

The controller 70 controls overall operation of the induction heating cooker. The controller 70 is communicatively connected to the first to fourth auxiliary controllers 60A, 60B, 60C, and 60D to control the driving of the heating coils L1-1 to L1-4, L2-1 to L2-4, L3-1 to L3-4, and L4-1 to L4-4 arranged at the respective rows of the 4×4 matrix and sends a control signal to the respective auxiliary controllers 60A, 60B, 60C, and 60D to control the driving of the heating coils L1-1 to L1-4, L2-1 to L2-4, L3-1 to L3-4, and L4-1 to L4-4.

The controller 70 controls the operations of the inverters 30A-1 to 30A-4, 30B-1 to 30B-4, 30C-1 to 30C-4, and 30D-1 to 30D-4 so that a process of supplying high-frequency power to the respective heating coils is alternately performed according to a container position detection command input through the input unit 80, and detects heating coils L on which the container P is placed using the values of current flowing in the respective heating coils L detected by the current detectors 40A-1 to 40A-4, 40B-1 to 40B-4, 40C-1 to 40C-4, and 40D-1 to 40D-4. The details of this control operation will be described below with reference to FIGS. 4A to 4C and 5.

To perform a cooking operation, the controller 70 controls the operations of the inverters 30A-1 to 30A-4, 30B-1 to 30B-4, 30C-1 to 30C-4, and 30D-1 to 30D-4 so that high-frequency power corresponding to a power level of the heating coils L input through the input unit 80 is supplied to the heating coils P on which the container is determined to be placed.

The controller 70 includes a memory 70-1 provided therein. The memory 70-1 stores reference values (predetermined values) used to determine whether a container P is placed on the heating coils L of the induction heating cooker.

The input unit 80 may include an ON/OFF button to turn power on or off, a detection button to input a container position detection command, a button to input information on the container P, a +/− button to adjust the power level of the heating coil L, and a start/pause button to start or pause a cooking operation, for example.

The display unit 90 displays position information of the heating coils L on which the container P is placed and the power level of the heating coils L input by a user through the +/− button.

The input unit 80 and the display unit 90 may be integrated. That is, the control panel 4 may display user input items in the form of a touch panel and the displayed portion may be touched by a user so that user intention is input to the controller 70 as an electrical signal.

In this embodiment, each of the auxiliary controllers 60A, 60B, 60C, and 60D is provided for four heating coils L arranged at each row of the heating coils L disposed in the 4×4 matrix and the controller 70 is provided to control the auxiliary controllers 60A to 60D. Alternatively, auxiliary controllers configured in different forms may be provided or only a single controller may control 16 coils without auxiliary controllers.

Hereinafter, a concrete control process of determining whether a container P is placed on a plurality of heating coils L will be described with reference to FIGS. 3 to 5.

Figure 3:
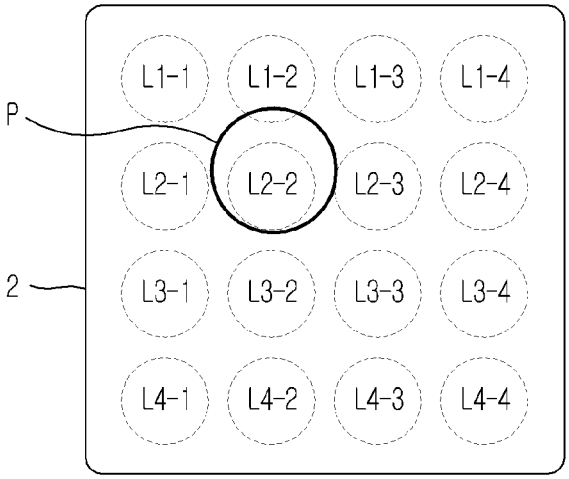
FIG. 3 is a plan view illustrating a container placed on heating coils of the induction heating cooker according to the embodiment.

FIG. 3 is a plan view illustrating a container placed on the heating coils of the induction heating cooker according to the embodiment.

As shown in FIG. 3, a container P is placed on the heating coils L1-2 and L2-2. Also, the container P is adjacent to the heating coil L2-3. In this case, the controller 70 theoretically determines that the container P is placed on the heating coils L1-2 and L2-2. However, the current detector 40 may detect current from the heating coil L2-3, to which the container P is adjacent. The detected current value is a noise current value even when the container P is placed on the heating coil L2-3.

Since the container P is placed on a large portion of the heating coil L2-2, the detected current value is large. Almost equal current values are detected from the heating coils L1-2 and L2-3. Consequently, a process of distinguishing between the heating coils L1-2 and L2-3 may be necessary. This distinction process is based on graphs shown in FIGS. 4A to 4C.

Figure 4A:
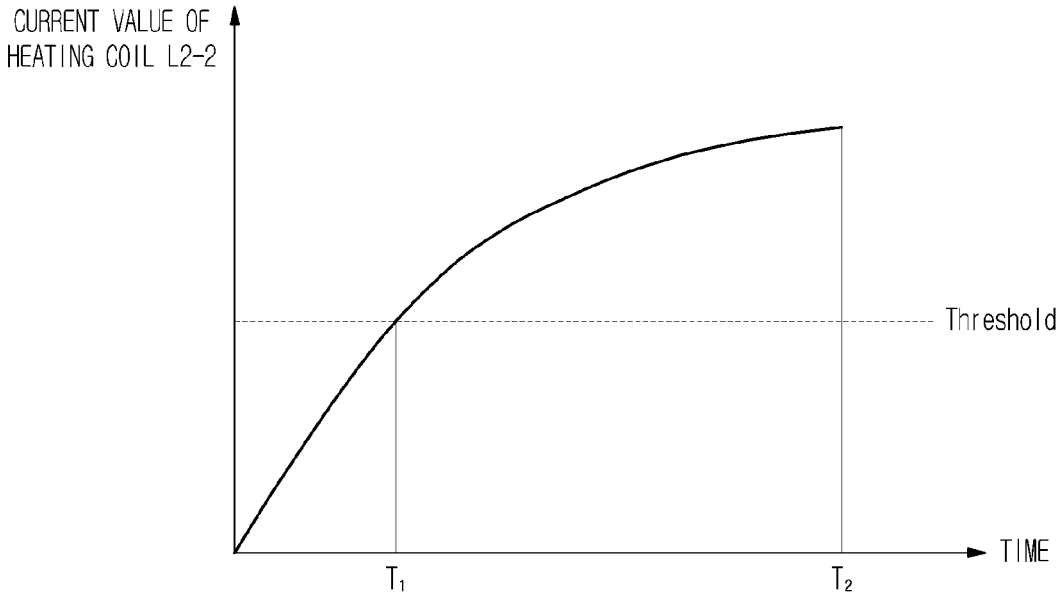
FIG. 4A to 4C are graphs illustrating values of current flowing in heating coils detected by current detectors of the induction heating cooker according to the embodiment.
Figure 4B:
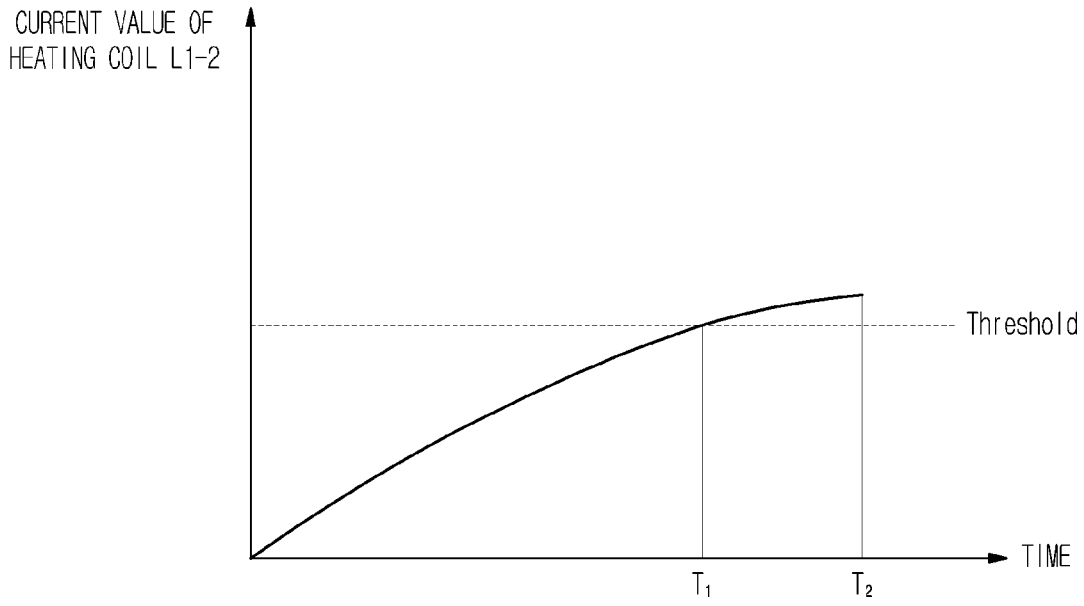
Figure 4C:
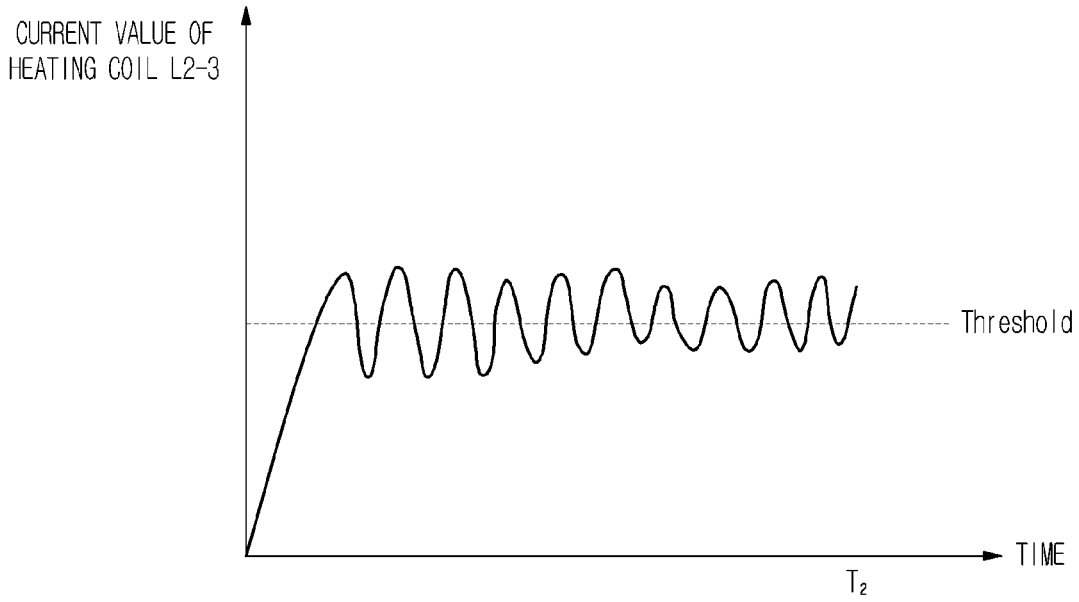

FIG. 4A to 4C are graphs illustrating values of current flowing in the heating coils detected by the current detectors of the induction heating cooker according to the embodiment.

The graph of FIG. 4A shows a time-based current value detected from the heating coil L2-2, the graph of FIG. 4B shows a time-based current value detected from the heating coil L1-2, and the graph of FIG. 4C shows a time-based current value detected from the heating coil L2-3.

The heating coils L2-2 and L1-2 having the current value graphs of FIGS. 4A and 4B are occupied by the container P. The heating coil L2-3 having the current value graphs of FIG. 4C is not occupied by the container; however, a current value almost equal to that of the heating coil L1-2 is detected from the heating coil L2-3. That is, a method of distinguishing between the heating coils L1-2 and L2-3 may be necessary.

The graph of FIG. 4A shows a case in which a container P is placed on a large portion of a heating coil L or a ferromagnetic container P, in which a large amount of current flows, is placed on the heating coil L like the heating coil L2-2 shown in FIG. 3.

The graph of FIG. 4B shows a case in which a container P is placed on a small portion of a heating coil L or a weak magnetic container P, in which a small amount of current flows, is placed on the heating coil L like the heating coil L1-2 shown in FIG. 3.

The graph of FIG. 4C shows a case in which no container P is placed on a heating coil L but a container P is placed on a neighboring heating coil L, by which a noise current value is detected, like the heating coil L2-3 shown in FIG. 3.

The induction heating cooker according to the embodiment distinguishes between the current value graph of the heating coil L1-2 and the current value graph of the heating coil L2-3 based on the current value and the amount of current value changed per unit time.

Distinction based on current values detected from the respective heating coils L as a first determination criterion will be described.

The induction heating cooker according to the embodiment includes the inverters 30, each of which has a switching element Q. The switching elements Q, each of which may be constituted by a transistor, receive a signal from the controller 70 so that the current detectors 40 detect current flowing in the heating coils L. That is, as previously described with reference to FIG. 2, the switching elements Q are electrically conducted or cut off according to a signal from the controller 70. During electrical conduction of the switching elements Q, the current detectors 40 detect current flowing in the heating coils L. For an ON time (time $T_2$ in the graph) of the switching elements Q of the inverters 30, the current detectors 40 detect values of current flowing in the heating coils L.

The current value of each heating coil L detected for time $T_2$ is compared with a predetermined value (a threshold value of the graphs). That is, the detected current value is compared with a threshold value, which is a predetermined value shown in FIGS. 4A to 4C.

The threshold value is a reference value by which it is determined that the container P is placed on the heating coil L. If the current value detected from the heating coil L is less than the threshold value, it means that no container P is placed on the heating coil L or a container P is not suitable for cooking although the container P is placed on the heating coil L. For example, if an aluminum container P is placed on the heating coil L, a current value less than the threshold value is detected. That is, if a container P made of an unsuitable material is placed on the heating coil L, it is determined that the container P is not placed on the heating coil L, and the controller 70 controls the corresponding heating coil L not to be driven.

Also, the current value of each heating coil L compared with the threshold value may be all current values detected during on time $T_2$ of the switching element Q or any one of the current values detected for time $T_2$.

Also, the current value of each heating coil L may be the maximum value or average value of the current values detected for time $T_2$ or all current values included in a predetermined section of time $T_2$.

That is, methods of sampling time-based current values are different from each other but the current value in a predetermined section of time $T_2$, time for which current detection is possible, an arbitrary representative value or the average current value may be used as a comparative value.

Hereinafter, comparison between a current value having a predetermined section of time $T_2$ with the threshold value in FIGS. 4A to 4C will be described as an example.

Referring to FIGS. 4A to 4C, there are sections having current values equal to or greater than the threshold value. A current value equal to or greater than the threshold value is detected in a section between time $T_1$ and $T_2$ of FIG. 4A (current value detected from the heating coil L2-2), in a section between time $T_1$ and $T_2$ of FIG. 4B and in several sections of FIG. 4C.

That is, distinction between the heating coil L1-2 on which the container P is actually placed and the heating coil L2-3 having a noise current value may not be possible only based on the current values detected during on time of the switching elements Q of the inverters 30.

Distinction based on the change amount of current values detected from the respective heating coils L as a second determination criterion will be described.

In comparison among the graph of the current value detected from the heating coil L2-2 shown in FIG. 4A, the graph of the current value detected from the heating coil L1-2 shown in FIG. 4B and the graph of the current value detected from the heating coil L2-3 shown in FIG. 4C, the current value continuously increases during on time of the switching element Q in the graph of the current value detected from the heating coil L2-2 shown in FIG. 4A and the graph of the current value detected from the heating coil L1-2 shown in FIG. 4B. The graph of the current value detected from the heating coil L2-2 shown in FIG. 4A and the graph of the current value detected from the heating coil L1-2 shown in FIG. 4B have a pattern in which the change amount of the current value detected from the heating coil L1-2 increases over time.

Here, a pattern in which the change amount of the current value during on time of the switching element Q increases over time means that the change amount of the current value has a positive value over the entire section during on time of the switching element Q although the change amount of the current value has a negative value in a small portion of the section.

In the graph of the current value detected from the heating coil L2-3 shown in FIG. 4C, on the other hand, the current value repeatedly increases and decreases during on time of the switching element Q. That is, the graph of the current value detected from the heating coil L2-3 shown in FIG. 4C does not have a pattern in which the overall change amount of the current value increases.

That is, the increase pattern is maintained in the graphs of FIGS. 4A and 4B, and the increase pattern is not maintained but is irregular in the graph of FIG. 4C. In particular, in comparison between the graphs of FIGS. 4B and 4C, the current values are almost equal to each other; however, FIG. 4B has a pattern in which the inclination of the current value is gentle but the change amount of the current value increases. In FIG. 4C, on the other hand, the change amount of the current value alternately has positive and negative values but FIG. 4C does not have a pattern in which the change amount of the current value increases as a whole.

In conclusion, it is determined whether the container P is placed on the heating coil L based on the above two determination criteria.

Hereinafter, a process of controlling the induction heating cooker according to the embodiment based on the determination method using the graph features as described above will be described with reference to a flow chart of FIG. 5.

Figure 5:
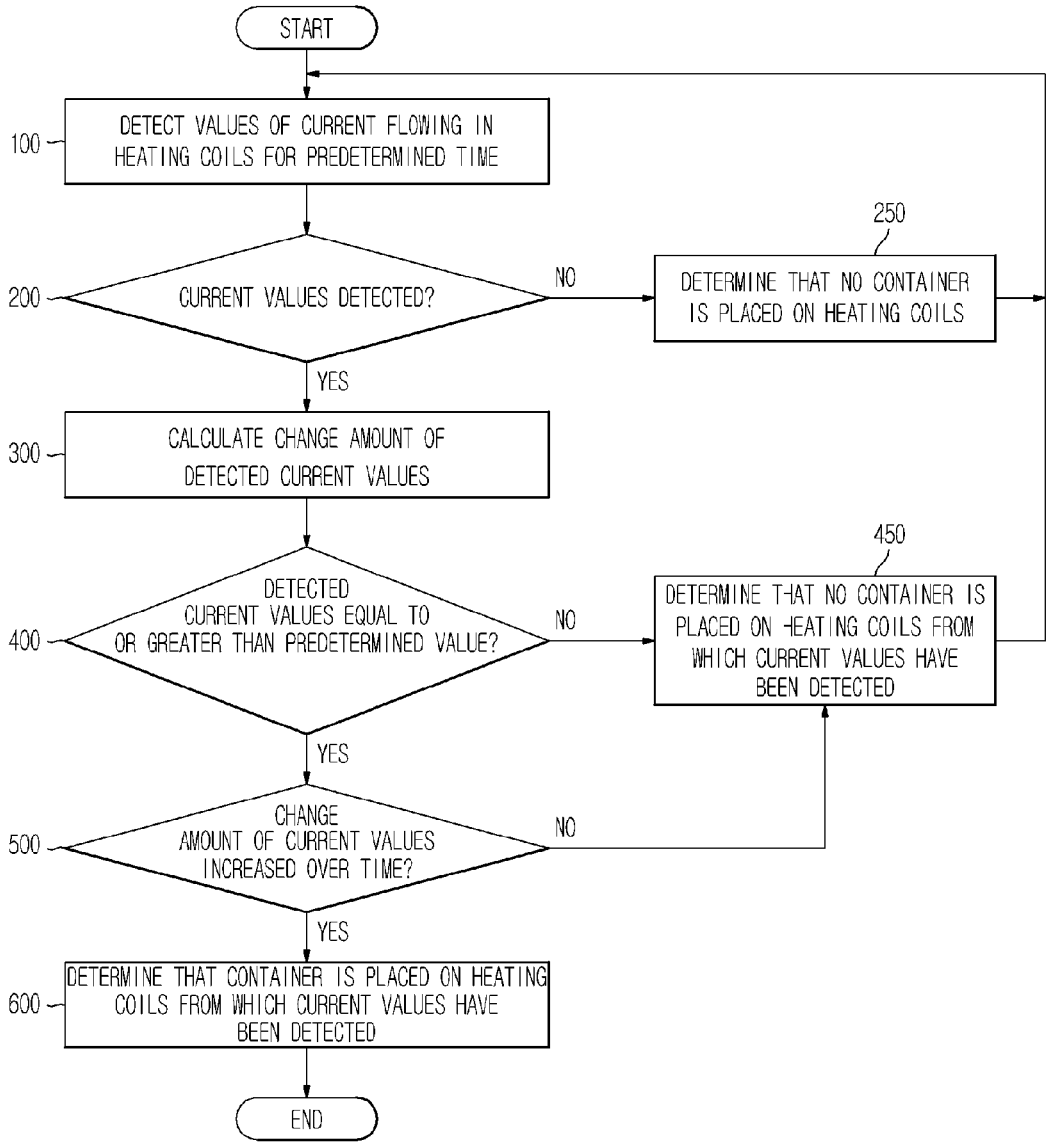
FIG. 5 is a flow chart illustrating a control process of the induction heating cooker according to the embodiment.

FIG. 5 is a flow chart illustrating a control process of the induction heating cooker according to the embodiment.

First, values of current flowing in a plurality of heating coils L are detected for a predetermined time (100). Subsequently, it is determined whether current values have been detected from the heating coils L (200). If no current values have been detected from the heating coils L, it is determined that no container P is placed on the heating coils L (250), and the procedure returns to Operation 100 to detect values of current flowing in the heating coils L for the predetermined time.

If current values have been detected from the heating coils L, the change amount of the detected current values per unit time is calculated (300). Subsequently, it is determined whether the detected current values are equal to or greater than a predetermined value (400). If the detected current values are less than the predetermined value, it is determined that no container P is placed on the heating coils L from which the current values have been detected (450), and the procedure returns to Operation 100 to detect values of current flowing in the heating coils L for the predetermined time.

If the detected current values are equal to or greater than the predetermined value, it is determined whether there is formed a pattern in which the calculated change amount of the current values during on time of the switching elements Q generally increases over time (500). If the increase pattern is not formed, it is determined that no container P is placed on the heating coils L from which the current values have been detected (450), and the procedure returns to Operation 100 to detect values of current flowing in the heating coils L for the predetermined time.

If the increase pattern is formed, it is determined that a container P is placed on the heating coils L from which the current values have been detected (600).

Alternatively, the control process of the induction heating cooker may be performed as follows.

The controller 70 divides on time of the switching elements Q into one or more sections, controls the current detectors 40 to detect current values in the respective sections at a predetermined time interval, calculates the average value of the current values detected by the current detectors 40 in the respective sections based on the detected current values, and determines whether there is formed a pattern in which the calculated average value of the current values in the respective sections increases over time to determine whether a container P is placed on the heating coils L.

Also, the controller 70 may calculate the average value of current values detected by the current detectors 40 in the respective sections excluding the maximum value and the minimum value.

As is apparent from the above description, a container recognition error phenomenon does not occur in the induction heating cooker that performs cooking regardless of where a container is placed on a cooking plate.

The above-described embodiments may be recorded in computer-readable media including program instructions to implement various operations embodied by a computer. The media may also include, alone or in combination with the program instructions, data files, data structures, and the like. The program instructions recorded on the media may be those specially designed and constructed for the purposes of embodiments, or they may be of the kind well-known and available to those having skill in the computer software arts. Examples of computer-readable media include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. The computer-readable media may also be a distributed network, so that the program instructions are stored and executed in a distributed fashion. The program instructions may be executed by one or more processors. The computer-readable media may also be embodied in at least one application specific integrated circuit (ASIC) or Field Programmable Gate Array (FPGA), which executes (processes like a processor) program instructions. Examples of program instructions include both machine code, such as produced by a compiler, and files containing higher level code that may be executed by the computer using an interpreter. The above-described devices may be configured to act as one or more software modules in order to perform the operations of the above-described embodiments, or vice versa.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. An induction heating cooker comprising:

a plurality of heating coils disposed below a cooking plate;

inverters having switching elements;

current detectors to detect values of current flowing in the respective heating coils during on time of the switching elements of the inverters; and a controller to determine that a container is placed on the respective heating coils if the current values detected from the respective heating coils during the on time of the switching elements are equal to or greater than a predetermined value and a pattern is formed in which the change amount of the current values during the on time of the switching elements increases over time.

2. The induction heating cooker according to claim 1, wherein the controller divides the on time of the switching elements into one or more sections, controls the current detectors to detect current values in the respective sections at a predetermined time interval, calculates an average value of the current values detected by the current detectors in the respective sections, and determines that the container P is placed on the respective heating coils if a pattern is formed in which the calculated average value of the current values in the respective sections increases over time.

3. The induction heating cooker according to claim 2, wherein the controller calculates an average value of the current values detected by the current detectors in the respective sections excluding a maximum value and minimum value thereof.

4. The induction heating cooker according to claim 1, wherein the current values of the respective heating coils detected during on time of the switching elements are current values of the respective heating coils detected in a predetermined section of the on time of the switching elements.

5. The induction heating cooker according to claim 4, wherein the current value of each of the heating coils equal to or greater than the predetermined value is one of the current values of the respective heating coils.

6. The induction heating cooker according to claim 4, wherein the current value of each of the heating coils equal to or greater than the predetermined value is a maximum value of the current values of the respective heating coils.

7. The induction heating cooker according to claim 4, wherein the current value of each of the heating coils equal to or greater than the predetermined value is an average value of the current values of the respective heating coils detected during the on time of the switching elements.

* * * * *